United States Patent [19]

Bousaid et al.

[11] 4,194,562

[45] Mar. 25, 1980

[54] METHOD FOR PRECONDITIONING A SUBTERRANEAN OIL-BEARING FORMATION PRIOR TO IN-SITU COMBUSTION

[75] Inventors: Issam S. Bousaid; Donald L. Hoyt, both of Houston; Ralph J. Korstad, Austin, all of Tex.

[73] Assignee: Texaco Inc., White Plains, N.Y.

[21] Appl. No.: 972,130

[22] Filed: Dec. 21, 1978

[51] Int. Cl.[2] ..... E21B 43/24

[52] U.S. Cl. ..... 166/245; 166/261

[58] Field of Search ..... 166/245, 256, 259–261

[56] References Cited

U.S. PATENT DOCUMENTS

| | | | |
|---|---|---|---|
| 3,019,837 | 2/1962 | Marx et al. | 166/256 |
| 3,126,953 | 3/1964 | Nelson et al. | 166/245 |
| 3,132,692 | 5/1964 | Marx et al. | 166/245 |
| 3,205,942 | 9/1965 | Sandberg | 166/245 |
| 3,209,825 | 10/1965 | Alexander et al. | 166/245 |
| 3,232,345 | 2/1966 | Trantham et al. | 166/245 |
| 3,472,318 | 10/1969 | Woodward | 166/245 |
| 3,905,422 | 9/1975 | Woodward | 166/256 X |
| 3,978,925 | 9/1976 | Redford | 166/261 |
| 3,999,606 | 12/1976 | Bandyopadhyay et al. | 166/245 |

*Primary Examiner*—Stephen J. Novosad

*Attorney, Agent, or Firm*—Robert A. Kulason; Carl G. Ries; Charles L. Bauer

[57] ABSTRACT

An in-situ combustion method for oil recovery from a subterranean oil-bearing formation traversed by a plurality of wells comprising a series of well pattern units wherein air permeability is established sequentially in the individual well pattern units pior to the initiation of in-situ combustion, thereby resulting in an increase in overall sweep efficiency.

8 Claims, 2 Drawing Figures

— FORMATION TRAVERSED BY A PLURALITY OF 5-SPOT PATTERNS HAVING UNDERGONE IN SITU COMBUSTION ACCORDING TO THE INSTANT INVENTION.

_. FORMATION TRAVERSED BY A PLURALITY OF 5-SPOT PATTERNS HAVING UNDERGONE IN SITU COMBUSTION ACCORDING TO PRIOR ART.

METHOD FOR PRECONDITIONING A SUBTERRANEAN OIL-BEARING FORMATION PRIOR TO IN-SITU COMBUSTION

BACKGROUND OF THE INVENTION

This invention relates to an improved method of recovery of oil from a subterranean oil-bearing formation utilizing in-situ combustion techniques. More particularly, this invention relates to the sequential establishment of air permeability in individual well pattern units that comprise a plurality of wells traversing the formation prior to the initiation of in-situ combustion, thereby increasing the sweep efficiency and resulting in increased oil recovery.

Oil is initially recovered from most subterranean oil-bearing formations by utilizing the natural energy contained therein, such as solution gas, gas pressure or natural water drive, whereby the formation oil is displaced through the formation to producing wells from which it is recovered. In most primary recovery operations the primary energy is depleted before the in-place oil has been recovered. Considerable oil, up to 75%, may remain unrecovered in the formation. Thus, it is the usual practice to undertake a secondary oil recovery method whereby additional oil may be recovered from the formation by providing additional energy to the formation, in the form of a drive mechanism.

One of the secondary recovery techniques that is employed is that of in-situ combustion, which involves combustion of a portion of the oil in the formation. In the conventional in-situ combustion method, applied to a formation traversed by at least one injection well and a spaced production well or wells, an oxygen-containing gas, such as air, is injected into the formation via the injection well traversing the formation and combustion of a portion of the oil adjacent the injection wellbore is initiated by one of a number of well-known methods such as a down-hole burner, a gas-fired or electric heater, or the use of chemicals. A high-temperature combustion front is formed, which is maintained and displaced through the formation toward the spaced production well or wells by the continued injection of the oxygen-containing gas. As the combustion front progresses through the formation the in-place oil is displaced ahead of the front toward the production well or wells from which the displaced oil is recovered.

In the application of in-situ combustion to large formations, a plurality of well pattern units may be used in which each unit comprises a central well and spaced offset wells. For example, the pattern units may be 5-spots in which the central well is an injection well and the four corner or offset wells are producing wells. The in-situ combustion operation may be applied to each 5-spot pattern simultaneously or individual 5-spot patterns may be produced in a phased sequence, dependent upon the capabilities and limitation of the air compressor units. In another scheme of operation, a line drive may be utilized wherein one row of wells serves as the injection wells and the two rows of wells on either side of the line of injection wells serve as producing wells. With this pattern, generally all of the injection wells are ignited at one time so as to develop a line drive combustion front.

In the portions of the formation swept by the combustion front, recovery, ideally, approaches 100% except for that fraction of the oil consumed as fuel to sustain the combustion. This fraction is generally in the range of 10% to 20% of the oil in place. While, ideally, excellent recovery is possible, in practice considerably less recovery is realized. Among the reasons for the lower recovery is that of poor sweep efficiency. Sweep efficiency is defined as the ratio of the area of the formation or pattern within the pathways of travel of the displacing fluid (i.e., air) to the total area of the formation or pattern. Practical operations from the standpoint of economics require a maximum sweep efficiency.

Poor sweep efficiencies may be attributable to anomalies in the formation characteristics such as permeability variations and porosity variations. For example, the combustion front may be channeled through the formation along paths of high permeability, thereby by-passing considerable oil in the formation instead of sweeping the oil as a bank from the injection well to the producing well.

Poor sweep efficiencies may also be caused by the movement of the combustion front itself. As the combustion front progresses outwardly into the formation, it changes shape from that of an ideally radial movement to one in which distortion occurs because of the pressure sinks around the producing wells. These sinks cause a portion of the front to accelerate and "cusp" toward the producing wells resulting in undesired early breakthrough of the combustion front at the producing wells. Once breakthrough occurs, the size of the area of the formation swept by the front is essentially fixed since subsequently injected air will travel almost entirely through the low resistance paths already available rather than try to force new channels through the formation. Consequently, considerable portions of the formation may be by-passed and thus the in-place oil is not recovered.

Prior art has suggested solutions to the problem of poor sweep efficiency by attempting to control the undesirable, irregular advancement of the front by, among other things, creating more favorable mobility ratios during the operation. It is known that sweep efficiency is dependent upon mobility ratio. The mobility ratio is defined as the ratio of the mobility of the displacing fluid divided by the mobility of the displaced fluid. Mobility, in turn, is dependent upon the viscosity of the fluid and the relative permeability of the formation to the fluids. With a more favorable mobility ratio, i.e., 1 or less, better sweep efficiency may be attained. One method of attaining a more favorable mobility ratio is to inject water alternately with the injected air.

Improved sweep efficiency may also be realized by inhibiting cusp formation. It is known that the geometry of well patterns or rate distribution may be used to control distortion of the front. Two principal means of accomplishing cusp retardation are (a) "pinning the cusp" by locating inner producing wells between the injection source and the outer producing wells and keeping these inner or control wells on production after breakthrough, and (b) "spreading the cusp" by pulling the front toward side wells until breakthrough thereat before allowing the front to proceed in the direction of the corner producing wells of a pattern unit.

In addition, there are many teachings for improving sweep efficiency involving geometry patterns, well positions and injection sequences. For example, U.S. Pat. No. 3,472,318 teaches a method of production in which in-situ combustion is initiated in an inverted 5-spot pattern unit. After breakthrough occurs at one of the producing wells, the well is converted to an injection well to receive the produced water, and the remaining wells are put on a stand-by basis, and production is commenced at a well adjacent the recently converted injection well. In U.S. Pat. No. 3,999,606 a method for improving in-situ recovery is taught wherein the pressure in the locus ahead of the front is increased by throttling the producing wells to selectively retard the front movement.

While these suggested methods to improve sweep efficiency have been applied and address themselves to the operation of the in-situ combustion itself, we have now found that improved sweep efficiency can be realized if, prior to the initiation of in-situ combustion, a conditioning of the formation is undertaken whereby the air permeability of the formation is improved so that the formation thereafter is more uniformly receptive to air for the ensuing in-situ combustion operation.

SUMMARY OF THE INVENTION

This invention relates generally to an improved method for the production of oil from subterranean oil-bearing formations, utilizing in-situ combustion, whereby prior to the initiation of in-situ combustion, the area invaded by the injected air is increased by means of an injection sequence applied to individual well pattern units during which time production rates are controlled.

DESCRIPTION OF THE PREFERRED EMBODIMENT

Figure 1:
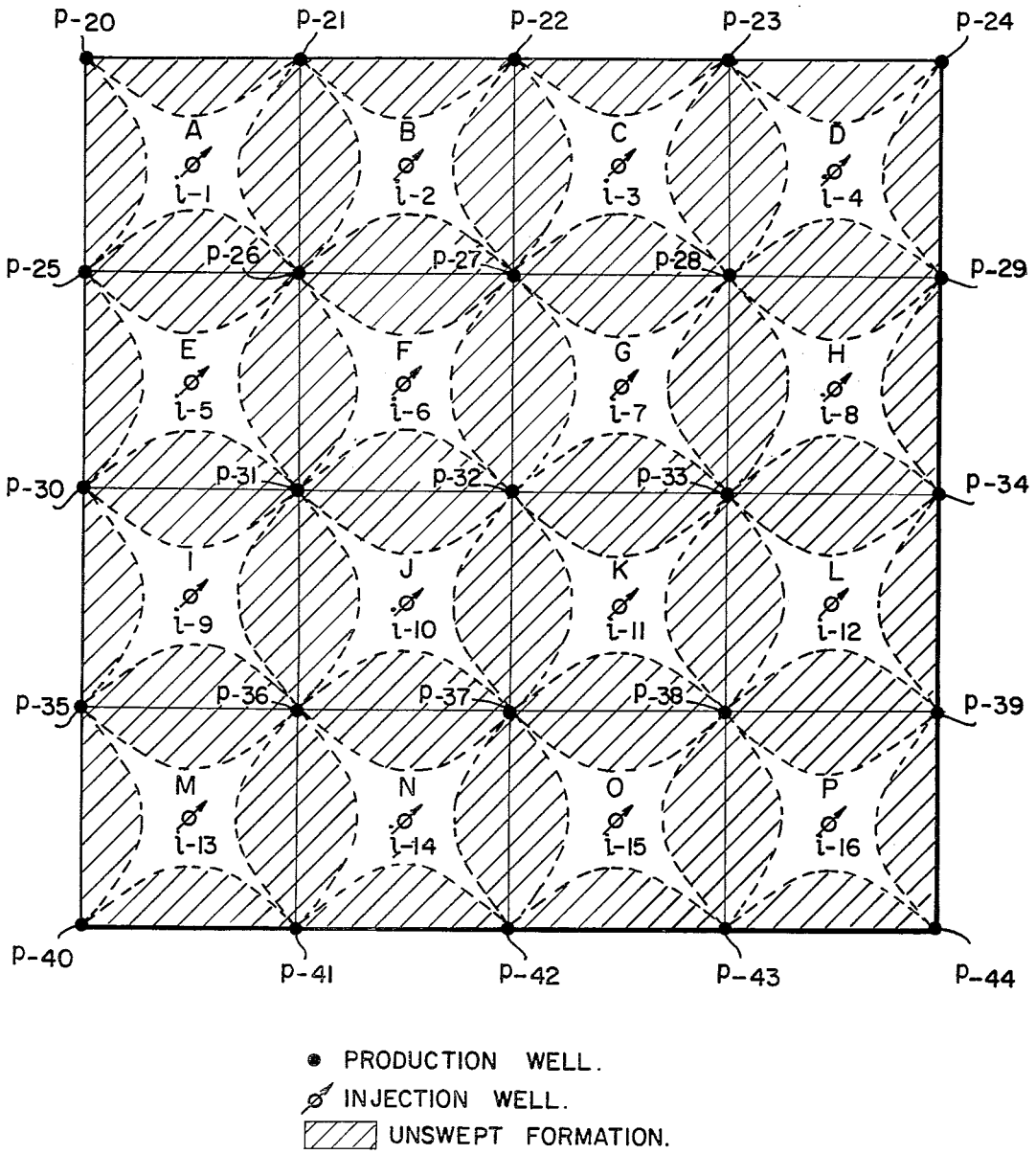
FIG. 1 illustrates an in-situ combustion operation applied according to the teachings of prior art to a plurality of wells arranged in conventional 5-spot patterns.

This invention relates to a method for increasing recovery of oil from an in-situ combustion operation whereby the sweep efficiency is improved by pretreatment or conditioning of the formation prior to the undertaking of in-situ combustion. More particularly, the invention involves a preconditioning injection sequence for improving air permeability, wherein the individual well pattern units comprising a plurality of wells traversing the formation are preconditioned by sequentially injecting air into each unit and controlling production rates during this period of preconditioning. The desired improved sweep efficiency is achieved, in effect, by removing or substantially minimizing the influence of the sink or the pressure drop at producing wells so that the injected air moves radially over a greater portion of the area between the injection and producing wells. By the manner of operation, a greater portion of the formation is invaded by the preconditioning air. With the initiation of the subsequent in-situ combustion, the area of contact of the air and the potential fuel having thus been increased, a greater portion of the area is exposed to the in-situ combustion resulting in increased recovery over the standard practice of in-situ methods.

In accordance with the invention, in a secondary recovery operation involving in-situ combustion applied to a subterranean oil-bearing formation having a plurality of wells in pattern units traversing the formation, the formation is preconditioned prior to the in-situ combustion operation. A gas, such as air, or other conveniently available gas, is injected into a selected injection well of one of a pattern unit of wells having n offset wells and fluid production is controlled from the n offset wells of the immediate pattern unit receiving injection. Production is also controlled from the other wells traversing the formation and without the specific pattern unit.

The gas or air is injected until the pressure in the formation is increased to a value below the fracturing pressure and gas or air is produced from the offset wells. For purposes of this illustration, the injected gas will be termed "air" in the following discussion. Liquid individual production rate is controlled by restricting the production of the producing wells in a reverse relationship to their distance from the injection well. The producing wells in the immediate pattern are severely restricted so that their production is limited to the detection of air. Their restriction may be about 1/20 of the rate of that of the next producing wells in an adjacent pattern. The producing wells spaced further from the central junction well and at a distance whereby they comprise parts of isolated pattern units may be produced at normal flow. For purposes of this invention, an isolated pattern unit is one that exists by itself from the standpoint that the direction of flow of the injected air is not affected by the presence of wells of the isolated pattern unit. Regulation of production rates is set by pressure measurements at the said production wells whereby the pattern unit of immediate interest is swept by air to insure permeability thereof.

After air has been detected at the immediate offset producing wells of the said pattern unit receiving injected air, thereby optimizing sweep efficiency and insuring air permeability, the injection well and the offset producing wells of the pattern unit are shut in and air injection is initiated at an adjacent pattern unit. Again, the offset wells spaced from the injection well are produced at controlled rates so that the maximum air sweep is attained in the second pattern unit receiving air injection. Because the first pattern unit is shut-in and is at a formation pressure greater than the pressure of the presently injected pattern unit, air intrusion during the time into the first pattern unit will be minimized.

With the detection of air from the producing wells of the second pattern unit, the sweep efficiency of the pattern unit is optimized. Its injection well and producing wells are shut-in and the next adjacent pattern unit is subjected to air injection with the producing wells controlled in the previously described manner. In like fashion each pattern undergoes air injection until the entire formation has been preconditioned.

While the preconditioning in accordance with the invention has been described employing air as the injection gas, other gases may be employed, such as nitrogen, methane, carbon dioxide, flue gas, and mixtures thereof. In the typical situation however, since generally air will be the oxygen-containing gas employed in the subsequent in-situ combustion operation, it will be conveniently available for the preconditioning of the formation.

Figure 2:
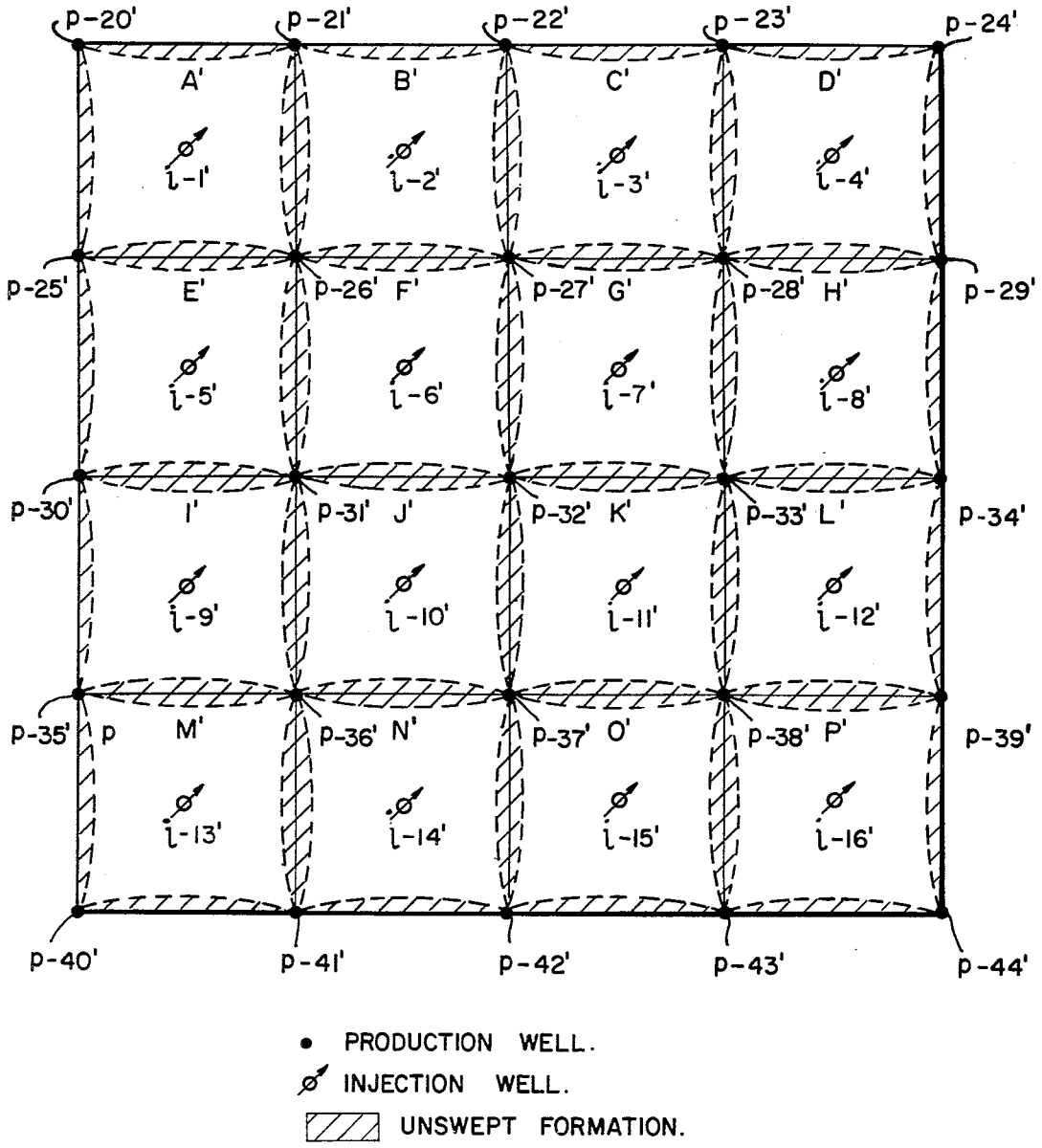
FIG. 2 illustrates an in-situ combustion operation applied according to the instant invention to a plurality of wells arranged in conventional 5-spot patterns.

While the method is applicable to line drive patterns or to patterns comprising a centrally located injection well and n offset wells, for purposes of demonstration, a plurality of 5-spot patterns is used as seen in FIGS. 1 and 2, both of which present an illustrative plan view of a multi-well oil field laid out in individual 5-spot pattern units. FIG. 1 represents a formation traversed by a plurality of 5-spot patterns that has been produced by in-situ combustion according to prior art. FIG. 2 represents a formation traversed by a plurality of 5-spot patterns that has been produced by in-situ combustion after the formation has been preconditioned by air injection according to the instant invention. In both Figures, the letters A through P represent individual 5-spot pattern units comprising the multi-field well pattern. The letters used are distinguished between the FIGS. 1 and 2, by using "primed" letters in FIG. 2. Thus, A' through L' represent the well pattern units in FIG. 2. Each of the 5-spot pattern units has an injection well, centrally located, and designated by a number preceded by "i"; for example, in 5-spot pattern A, the injection well is indicated as "i-1". Similarly, the other injection wells are designated as "i-2" in pattern B through "i-16" for pattern P. Again, primed letters are used in FIG. 2. The producing wells and the offset wells for each pattern unit are designated by a number preceded by "p", for example, the four offset producing wells in pattern A are designated, clockwise, p-20, p-21, p-26 and p-25. In following the sequence of numbered producing wells through each pattern unit the producing wells for pattern P are seen to be, clockwise, p-38, p-39, p-44 and p-43.

Referring now to FIG. 1, illustrating the conventional application of an in-situ operation to a formation and assuming there is no limitation on equipment, such as air compressor requirements necessary to deliver the required air, in-situ combustion is initiated in pattern unit A and adjacent the wellbore of central well i-1. Thereafter, air is continued to be injected into the central injection well i-1 and production occurs at the respective offset wells, p-20, p-21, p-26 and p-25. Because principally of the effects of pressure drop across the formation and unfavorable mobility ratios, the combustion front in pattern A will be greatly distorted from a radial movement to one cusping toward the producing wells as indicated by dashed lines in FIG. 1. Even in an idealized case as applied to an isotropic formation, the sweep efficiency for the injected air may attain approximately 50% of the formation at breakthrough of the cusps at the respective producing wells as illustrated in pattern A, wherein the hatched area represents the pattern unswept by the injected air at time of breakthrough. Simultaneous injection and production of all patterns in the multi-well field will result in the sweep configuration for the formation as shown in FIG. 1 and designated by the dotted arc lines. It can be seen that considerable oil has been uncovered as represented by the hatched areas of the pattern.

It should be noted that while a sweep efficiency of about 50% has been assumed in the example, sweep efficiency will more probably be much lower because of the unfavorable mobility ratios. For example, it has been postulated that the sweep efficiency could be as low as 28% if the mobility is 100 or greater, as is the usual case with an in-situ combustion in which the displacing fluid is air.

Referring now to FIG. 2, the improvement of the instant invention is illustrated wherein the formation undergoes a preconditioning by air injection, prior to the initiation of in-situ combustion. In the formation, a 5-spot pattern, pattern unit A' is selected and air injection is initiated via central well i-1'. Its four offset wells, p-20', p-21', p-26' and p-25' are essentially shut-in, that is, their production is strictly limited, so as to detect the production of air. Their rates may be restricted, for example, to about 1/20 of the air injection rate. Air injection is continued into pattern A' via the central well i-1' until the pressure of the immediate pattern has increased to a value below the fracturing pressure and air is detected at the offset wells p-20', p-21', p-26' and p-25'. During this period other injection wells are shut-in, but the producing wells of isolated patterns may be produced. Further, in accordance with the invention, the producing wells in the adjacent patterns, i.e., B', F' and E' are controlled so that their production is restricted according to their distance from the central injection well i-1'. The operational scheme involves the consideration of the 5-spot pattern units in terms of isolated patterns as defined heretofore. For the illustration in FIG. 2, when pattern unit A' is undergoing preconditioning by air injection, isolated pattern units would comprise C', G', K', J' and I' and those 5-spot pattern units yet further away from pattern A'. That is, the producing wells of these patterns do not affect the air movement in pattern unit A', and thus production from these isolated pattern units is at essentially unrestricted conditions during the period of an injection into pattern unit A'. Which pattern units are isolated for a given injection into a given 5-spot may be determined by producing the producing wells of the adjacent and outer 5-spot patterns for a brief interval during the air injection in pattern A' and observing whether there is pressure response at the various producing wells. Accordingly, the producing wells in the field have their production restricted to the extent that producing these wells will affect the air injection into pattern A'.

Air injection is continued into pattern unit A' until air is detected at its producing wells. The formation pressure across the pattern unit should be less than the formation fracturing pressure. After the air is detected at the producing wells, the injection well, i-1', is shut-in together with its corresponding producing wells p-20', p-21', p-26' and p-25' in pattern A'. Air injection is then undertaken in an adjacent pattern unit, e.g. pattern unit B'. The scheme is similar to that employed in pattern unit A', namely air is injected via central well i-2' and the offset wells p-21', p-22', p-27' and p-26' are produced under controlled restricted conditions to the extent that air can be detected. The producing wells in other pattern units are likewise controlled according to their distance from i-2'. When pattern unit B' is undergoing air injection, the isolated pattern units may be considered as D', H', L', K', J', I', M', N', O' and P'. Since pattern unit A' has undergone air injection and is now shut-in, its pressure is greater than that of the adjacent pattern unit B', and air intrusion into pattern A' will therefore be minimized during this time. The scheme of air injection from pattern unit to pattern unit is continued until all individual well pattern units have been so treated. The air injection sequence set forth by the invention will result in an improved sweep efficiency up to about 95% of the formation as shown by the dotted arc lines in FIG. 2. Once the entire formation has been so treated, an in-situ combustion operation is initiated in the formation by means well-known in the art.

While selection of the sequence of well pattern units for air injection should not materially affect the overall preconditioning, the size, and, to a lesser extent, the shape of the formation should be considered. For example, if the number of well pattern units is relatively large, that is over 20, it may be possible to inject into more than one well pattern unit at a time, provided there are isolated patterns between those patterns in which simultaneous air injection is being undertaken. In addition, the air injection should be initiated, when possible, into the higher structure or updip end of the formation.

While the invention has been described in terms of pattern units having a central injection well and n offset producing wells, and in particular, a 5-spot pattern unit, the invention may be applied prior to undertaking a line drive in-situ combustion operation. For purposes of the invention, a line drive pattern arrangement, that is, a plurality of wells of substantially parallel rows, may be considered as comprising well pattern units having a central injection well and n offset producing wells, wherein the injection well is located in a row of injection wells, and the offset wells are located in rows of producing wells spaced on either side of the row of injection wells. The preconditioning of the formation, would thus be undertaken in a manner analogous to that described heretofore. However, in undertaking the subsequent in-situ combustion, in the line drive case, the initiation of the in-situ combustion would be in the row of injection wells as to develop a combustion front as a line drive moving outwardly toward the spaced rows of producing wells.

In summary, the invention relates to the preconditioning of a subterranean oil-bearing formation traversed by a plurality of well pattern units prior to the undertaking of an in-situ combustion operation, whereby air permeability and sweep efficiency are improved. Preconditioning is accomplished by the injection of air into each well pattern unit while simultaneously controlling fluid production thereby minimizing pressure sinks that induce cusping. By the method of operation, the ideal radial advance of the injected air may be closely approached within the pattern units. As a result, a greater volume of the formation is invaded by air so that more of the formation will be swept by the subsequent in-situ combustion operation that usually follows the areas invaded by air, resulting in additional oil recovery.

As will be apparent to those skilled in the art, other changes and alterations are possible in the practice of the invention without departing from the spirit and scope thereof.

We claim:

1. In a method for the recovery of oil from a subterranean oil-bearing formation utilizing in-situ combustion, said formation being traversed by a plurality of wells in adjacent well pattern units, each of said well pattern units having a central well and n spaced offset wells, the improvement comprising, preconditioning of said formation by the injection of a gas thereinto, prior to the initiation of said in-situ combustion, said preconditioning comprising the steps of:

(a) selecting one of said well pattern units having a central well and n offset wells and injecting said gas into said central well while simultaneously restricting flow from said n offset wells and from said wells in said adjacent pattern units, (b) continuing injection of said gas into said central well until the pressure in said formation traversed by said selected pattern unit is increased to a value less than the fracturing pressure of said formation and gas is produced from said n offset wells, (c) shutting-in said central well and said n offset wells, (d) selecting a second of said pattern units comprising a second central well and its related n offset wells and injecting gas into said second central well while simultaneously restricting flow from said related n offset wells and from said wells in said adjacent pattern units, (e) sequentially repeating steps (a) through (d) for the remaining well pattern units until all said pattern units of said formation have undergone said preconditioning by the injection of gas thereinto, (f) undertaking an in-situ combustion operation in said formation.

2. The method of claim 1 wherein said gas is air, nitrogen, carbon dioxide, flue gas and mixtures thereof.

3. The method of claim 1 wherein each of said well pattern units comprises a 5-spot pattern consisting of a central injection well and four offset producing wells, wherein n is equal to 4.

4. The method of claim 1 wherein each of said well pattern units comprises a central injection well contained in a row of injection wells and said offset wells are contained in substantially parallel rows of producing wells spaced from said row of injection wells.

5. The method of claim 1 wherein said in-situ combustion is conducted in a radially expanding operation outwardly from said injection well in each of said well pattern units.

6. The method of claim 1 wherein said in-situ combustion is conducted in a line drive operation.

7. The method of claim 1 wherein the production from said n offset wells of said well pattern unit is restricted during injection into said central well so that the production rate is about 1/20 that of the injection rate.

8. The method of claim 1 wherein the production from offset wells in said adjacent well pattern units is inversely proportional to the distance from said central well.

* * * * *